US008496134B2

(12) United States Patent
Springer et al.

(10) Patent No.: US 8,496,134 B2
(45) Date of Patent: Jul. 30, 2013

(54) PET WASTE BAG DISPENSER

(76) Inventors: Ruth Springer, St. Louis, MO (US); Jeffrey Springer, St. Louis, MO (US)

( * ) Notice: Subject to any disclaimer, the term of this patent is extended or adjusted under 35 U.S.C. 154(b) by 0 days.

(21) Appl. No.: 13/239,839

(22) Filed: Sep. 22, 2011

(65) Prior Publication Data

US 2013/0075415 A1 Mar. 28, 2013

(51) Int. Cl.

| | |
|---|---|
| ***B65D 83/08*** | (2006.01) |
| ***B65D 83/00*** | (2006.01) |
| ***B65H 16/02*** | (2006.01) |
| ***B65H 1/00*** | (2006.01) |
| ***B65H 3/00*** | (2006.01) |

(52) U.S. Cl.
USPC ..... 221/34; 221/45; 221/92

(58) Field of Classification Search
USPC ..... 221/26, 33, 34, 44–46, 61–63, 92, 221/197, 199, 281–283, 303
See application file for complete search history.

(56) References Cited

U.S. PATENT DOCUMENTS

| | | | | |
|---|---|---|---|---|
| 1,577,641 | A * | 3/1926 | Hunt | 221/58 |
| 4,527,693 | A * | 7/1985 | Membrino | 206/554 |
| 5,170,957 | A * | 12/1992 | Carpenter | 242/588.3 |
| 5,921,512 | A * | 7/1999 | Torres | 248/99 |
| 6,170,692 | B1 | 1/2001 | Johnston | |
| 7,624,881 | B2 * | 12/2009 | Wilfong, Jr. | 211/59.2 |
| 2002/0079322 | A1 * | 6/2002 | Wilkes et al. | 221/34 |
| 2002/0139811 | A1 * | 10/2002 | Tramontina et al. | 221/197 |
| 2007/0012714 | A1 * | 1/2007 | Bagwell et al. | 221/33 |

OTHER PUBLICATIONS

"Complete Pet Waste Stations," available at http://www.zerowasteusa.com/Pet-Waste-Stations-Prodlist.html, printed on Sep. 22, 2011, 1 page.
"Pet Waste Bag Dispensers," available at http://www.zerowasteusa.com/Bag-Dispensers-Prodlist.html, printed on Sep. 22, 2011, 2 pages.

* cited by examiner

*Primary Examiner* — Gene Crawford
*Assistant Examiner* — Kelvin L Randall, Jr.
(74) *Attorney, Agent, or Firm* — Armstrong Teasdale LLP

(57) ABSTRACT

A pet waste bag dispenser includes a housing defining an interior compartment and having at least one opening in communication with the interior compartment. A positioner is located within the interior compartment of the housing and configured to position at least one box containing rolled pet waste bags relative to the opening such that the rolled pet waste bags can be dispensed through the opening in the housing. The positioner is also configured to position a plurality of stacked pet waste bags relative to the opening such that the stacked pet waste bags can be dispensed through the opening in the housing.

15 Claims, 15 Drawing Sheets

PET WASTE BAG DISPENSER

FIELD

The field of this invention relates generally to pet waste bag dispensers and more particularly to a pet waste bag dispenser adapted to store and dispense both rolled pet waste bags and stacked pet waste bags.

BACKGROUND

Pet waste bag dispensers are often placed in parks or along trails/walking paths frequented by pets and their owners to make it easy for the owners to clean up after their pets. Known pet waste bag dispensers include metal boxes configured to dispense pet waste bags through an opening in the box. Thus, pet waste bags are readily available to the owner should the need arise.

The pet waste bags are typically available either rolled or stacked. As a result, known pet waste bag dispensers are available to dispense either the rolled pet waste bags or the stacked pet waste bags, not both. Thus, once the pet waste bag dispenser is purchased, the owner or service provider responsible for maintaining (e.g., stocking) the pet waste bag disperser is limited to a single type of bag that can be used with the dispenser. That is, stacked pet waste bags cannot be used in pet waste bag dispensers configured for rolled pet waste bags, and rolled pet waste bags cannot be used in pet waste bag dispensers configured for stacked pet waste bags.

As a result, there is a need for a pet waste bag dispenser that is adapted to store and dispense both rolled pet waste bags and stacked pet waste bags.

SUMMARY

In one aspect, a pet waste bag dispenser generally comprises a housing defining an interior compartment and having at least one opening in communication with the interior compartment. A positioner is located within the interior compartment of the housing and configured to position at least one box containing rolled pet waste bags relative to the opening such that the rolled pet waste bags can be dispensed through the opening in the housing. The positioner is also configured to position a plurality of stacked pet waste bags relative to the opening such that the stacked pet waste bags can be dispensed through the opening in the housing.

In another aspect, a pet waste bag dispenser generally comprises a housing defining an interior compartment and having at least one opening in communication with the interior compartment. The interior compartment is sized and shaped to receive one of at least one box of rolled pet waste bags and a plurality of stacked pet waste bags. A positioner is located within the interior compartment of the housing. The positioner includes a pair of spaced prongs, a medial portion extending generally vertically downward from each of the prongs, a pair of spacing portions extending at an angle relative to the medial portions, and a connecting portion extending between and connecting the spaced portions. The positioner is configured to position the at least one box containing rolled pet waste bags relative to the opening such that the rolled pet waste bags can be dispensed through the opening in the housing. The connecting portion is configured to extend across the box of rolled pet waste bags disposed between the spacing portions of the positioner. The positioner is also configured to position a plurality of stacked pet waste bags relative to the opening such that the stacked pet waste bags can be dispensed through the opening in the housing. The prongs of the positioner are adapted to support the plurality of stacked bags such that the bags are disposed adjacent the opening in the housing and the connecting portion is arranged to locate the stacked bags adjacent the opening in the housing when the stacked bags are supported by the prongs.

BRIEF DESCRIPTION OF THE DRAWINGS

Corresponding reference characters indicate corresponding parts throughout the drawings.

DETAILED DESCRIPTION OF THE DRAWINGS

Figure 4:
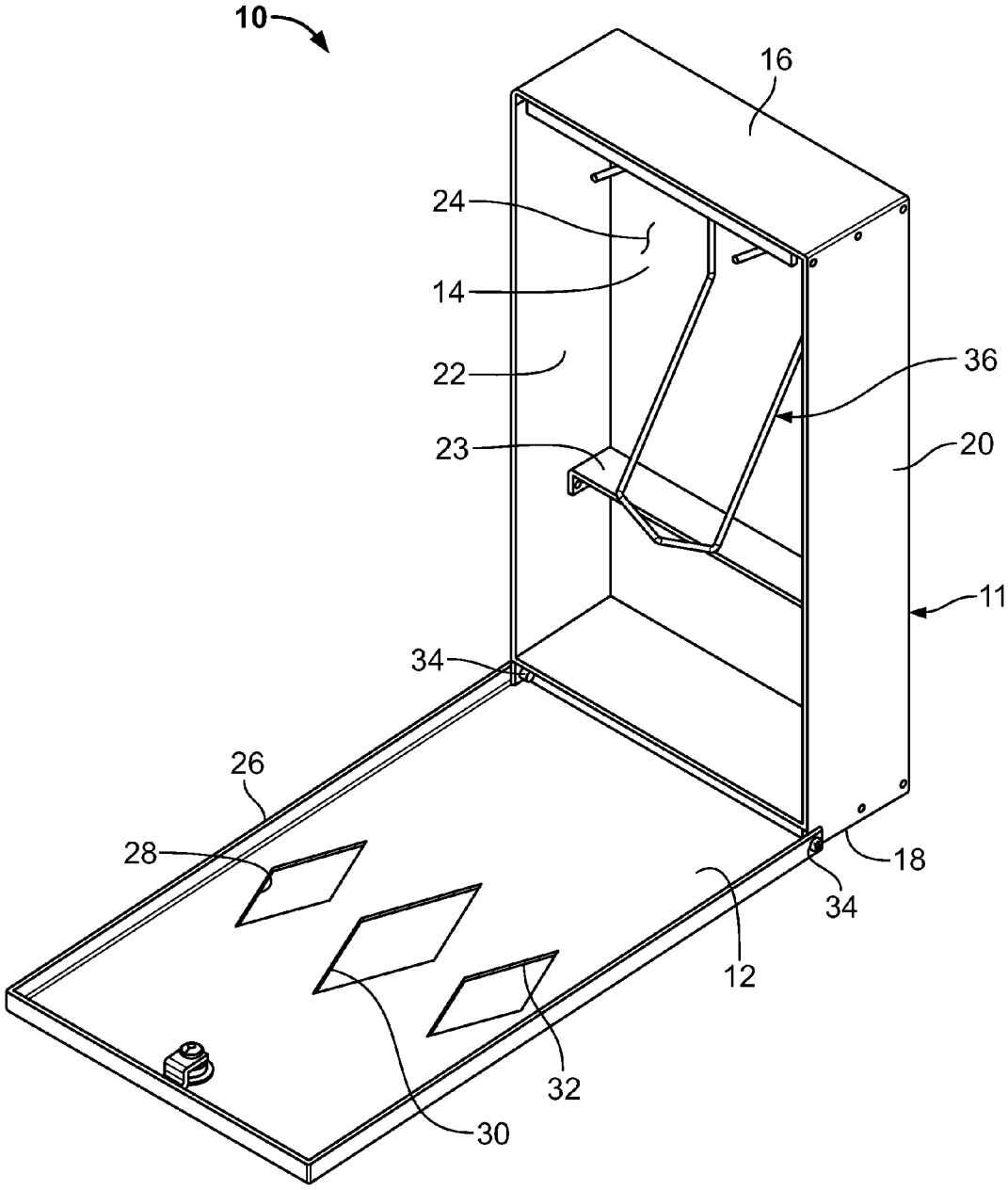
FIG. 4 is a perspective of the pet waste bag dispenser in an opened position.
Figure 5:
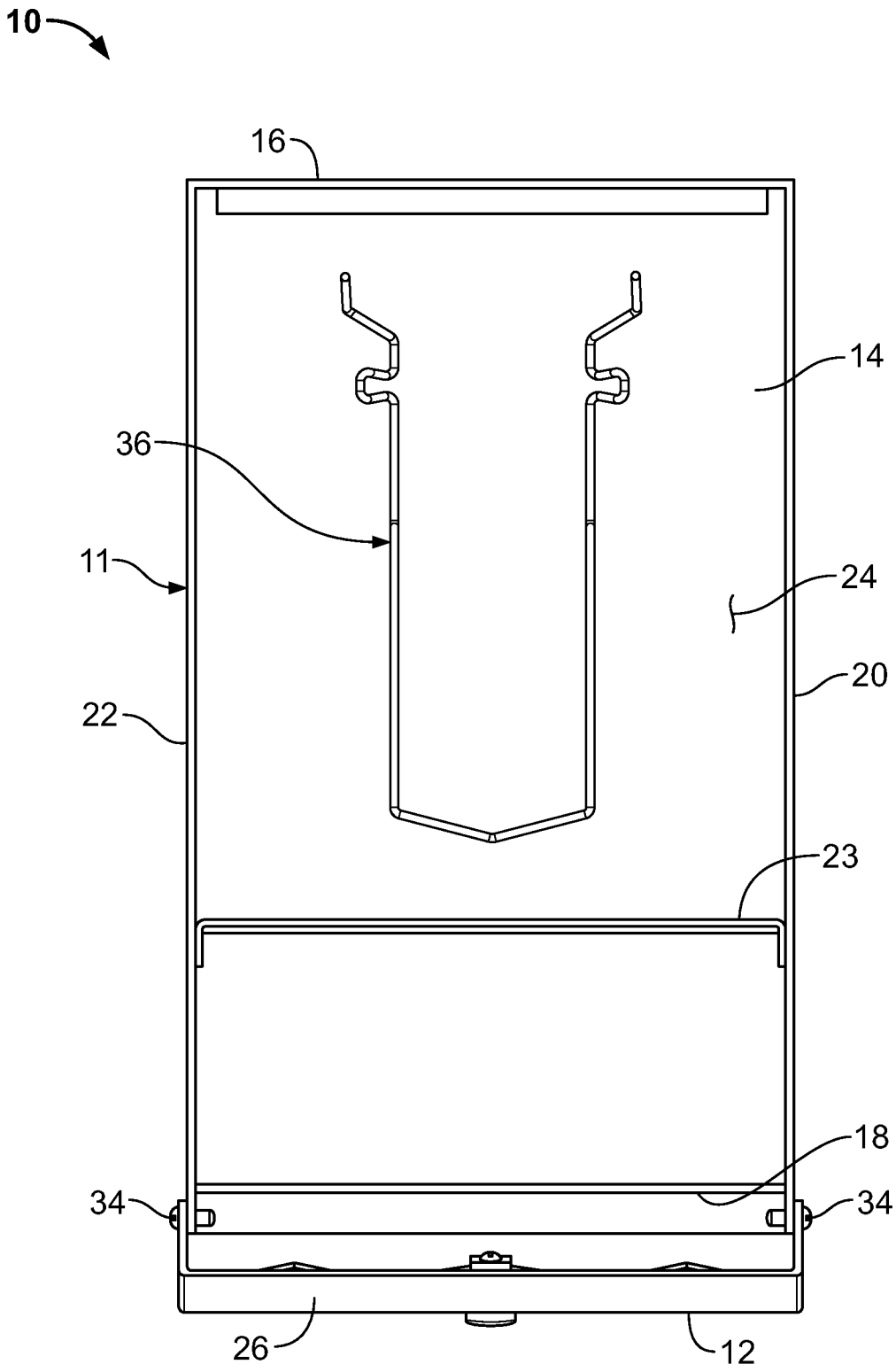
FIG. 5 is a front view of the pet waste bag dispenser of FIG. 1 in the opened position.

Referring now to the drawings, FIG. 1-6 illustrate one embodiment of a pet waste bag dispenser, indicated generally at 10, adapted to store and dispense both rolled pet waste bags and stacked pet waste bags. In the illustrated embodiment, the pet waste bag dispenser 10 comprises a rectangular box-shaped housing, indicated generally at 11. It is understood, however, that the housing 11 of the pet waste bag dispenser 10 can have any suitable shape (e.g., cube, circular, triangular). As seen in FIGS. 1-6, the housing 11 of the illustrated pet waste bag dispenser 10 comprises a front panel 12, a back panel 14, a top panel 16, a bottom panel 18, and a pair of side panels 20, 22. A shelf 23, which is illustrated in FIGS. 4 and 5, extends between the side panels 20, 22. The front panel 12 includes a flange 26 arranged to overlap the top panel 16 and the side panels 20, 22.

As seen in FIGS. 4 and 5, the front panel 12, the back panel 14, the top panel 16, the bottom panel 18, and the side panels 20, 22 cooperatively define an interior compartment 24 of the pet waste bag dispenser 10. In the illustrated embodiment, the front panel 12 is hingedly connected to the bottom panel 18 via a pair of hinges 34 for movement between a closed position (FIGS. 1-3) of the pet waste bag dispenser wherein access to the interior compartment 24 is inhibited and an opened position of the pet waste bag dispenser (FIGS. 4-6) wherein access to the interior compartment is permitted. It is understood, however, that the front panel 12 can be hingedly connected to the top panel 16 or one of the side panels 20, 22. For example, in one suitable embodiment, the front panel 12 can be hingedly connected to the left side panel 22 (as viewed in FIG. 5) such that the front panel pivots from the right toward the left.

Figure 6:
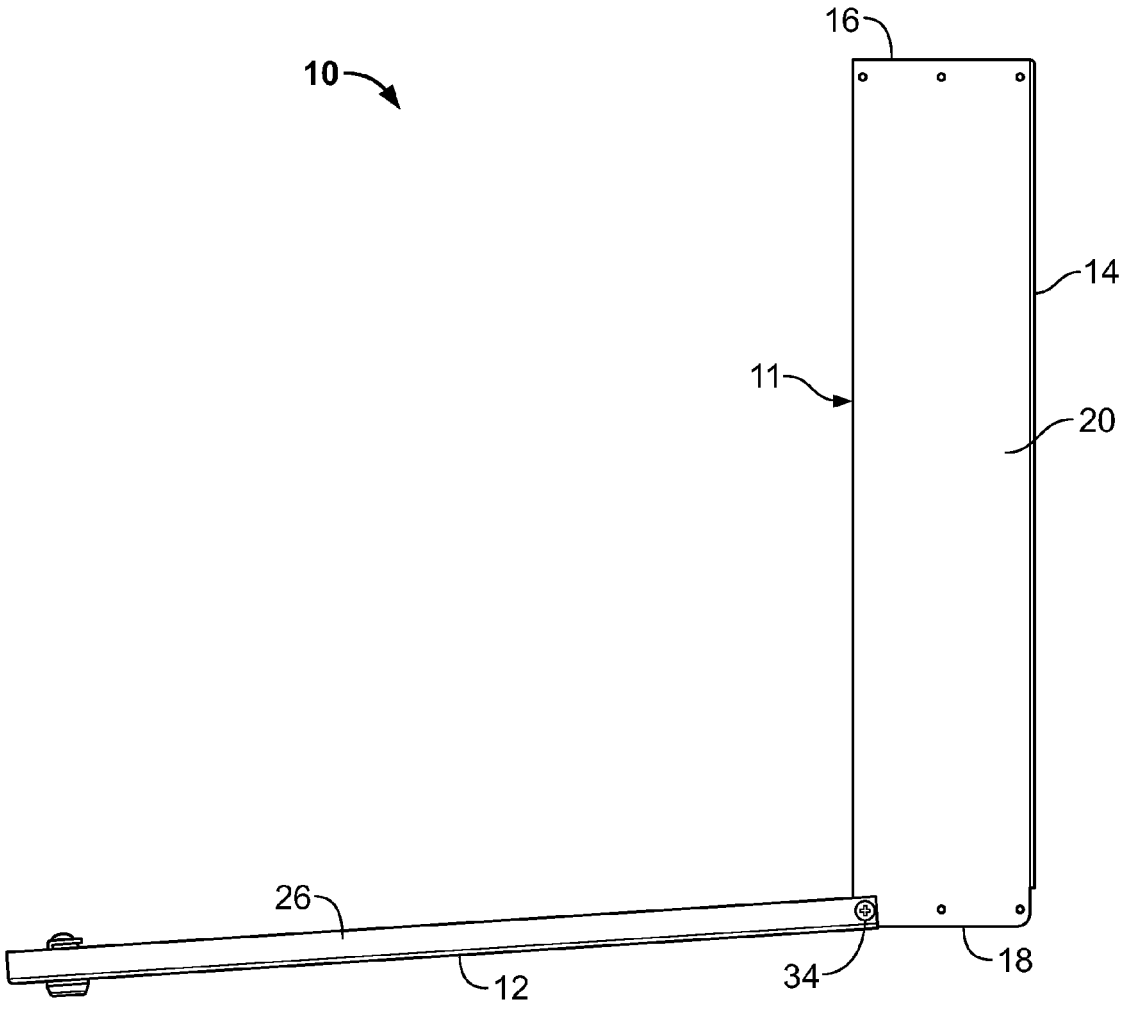
FIG. 6 is a side view of the pet waste bag dispenser in the opened position.

To move the illustrated pet waste bag dispenser 10 from the closed position to the opened position, the front panel 12 is manually pivoted downward (i.e., moved away from the top panel 16). In the illustrated embodiment, the front panel 12 lies approximately in the same plane as the bottom panel 18 when the pet waste bag dispenser 10 is in the opened position (FIG. 6). In other words, the pet waste bag dispenser 10 is configured such that the front panel 12 pivots approximately 90 degrees between the opened and closed positions. It is understood, however, that the front panel 12 can pivot more or less than approximately 90 degrees. In one suitable embodiment, for example, the front panel can pivot approximately 180 degrees.

Figure 1:
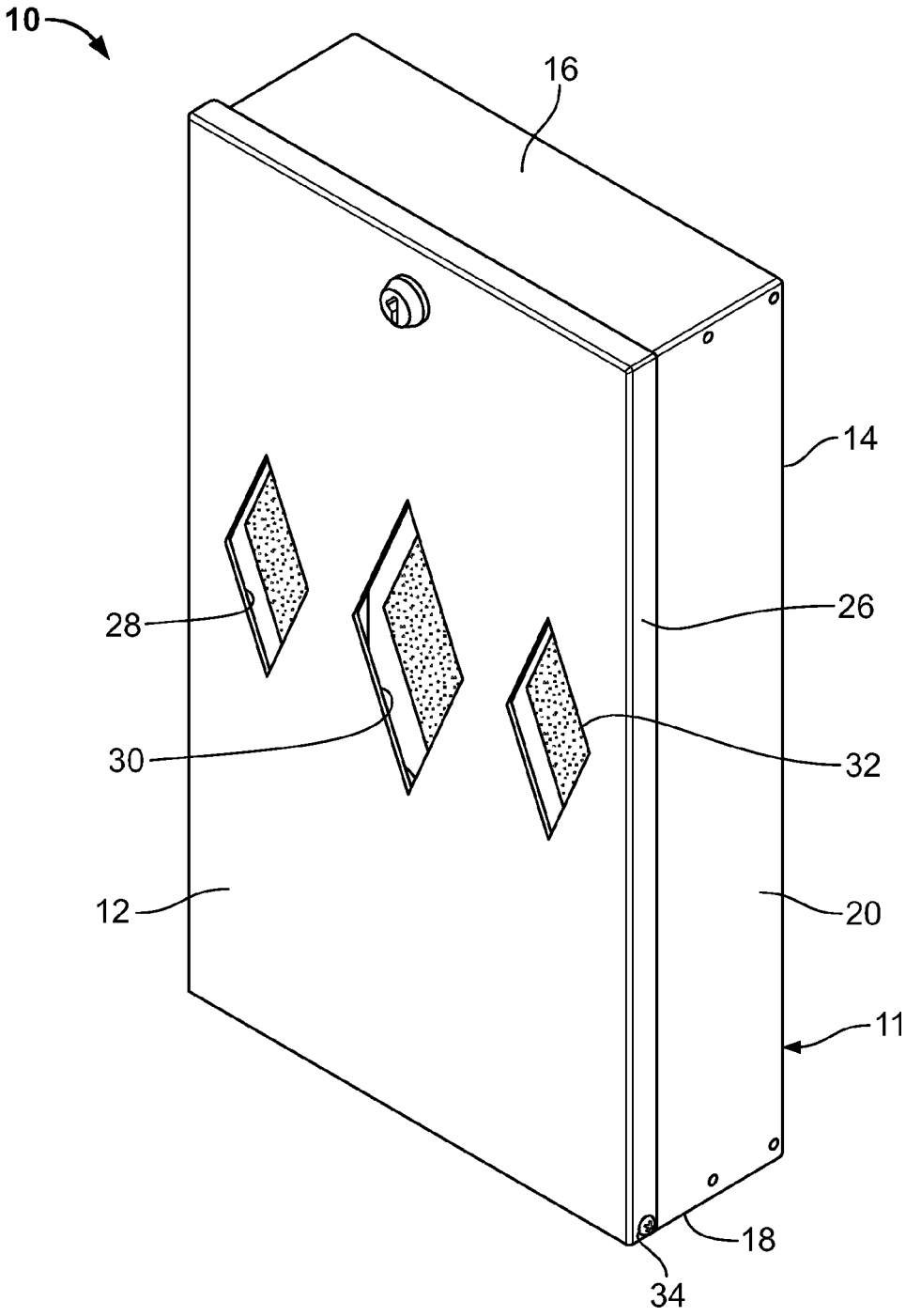
FIG. 1 is a perspective of one embodiment of a pet waste bag dispenser adapted to store and dispense both rolled pet waste bags and stacked pet waste bags, the pet waste bag dispenser being in a closed position.
Figure 2:
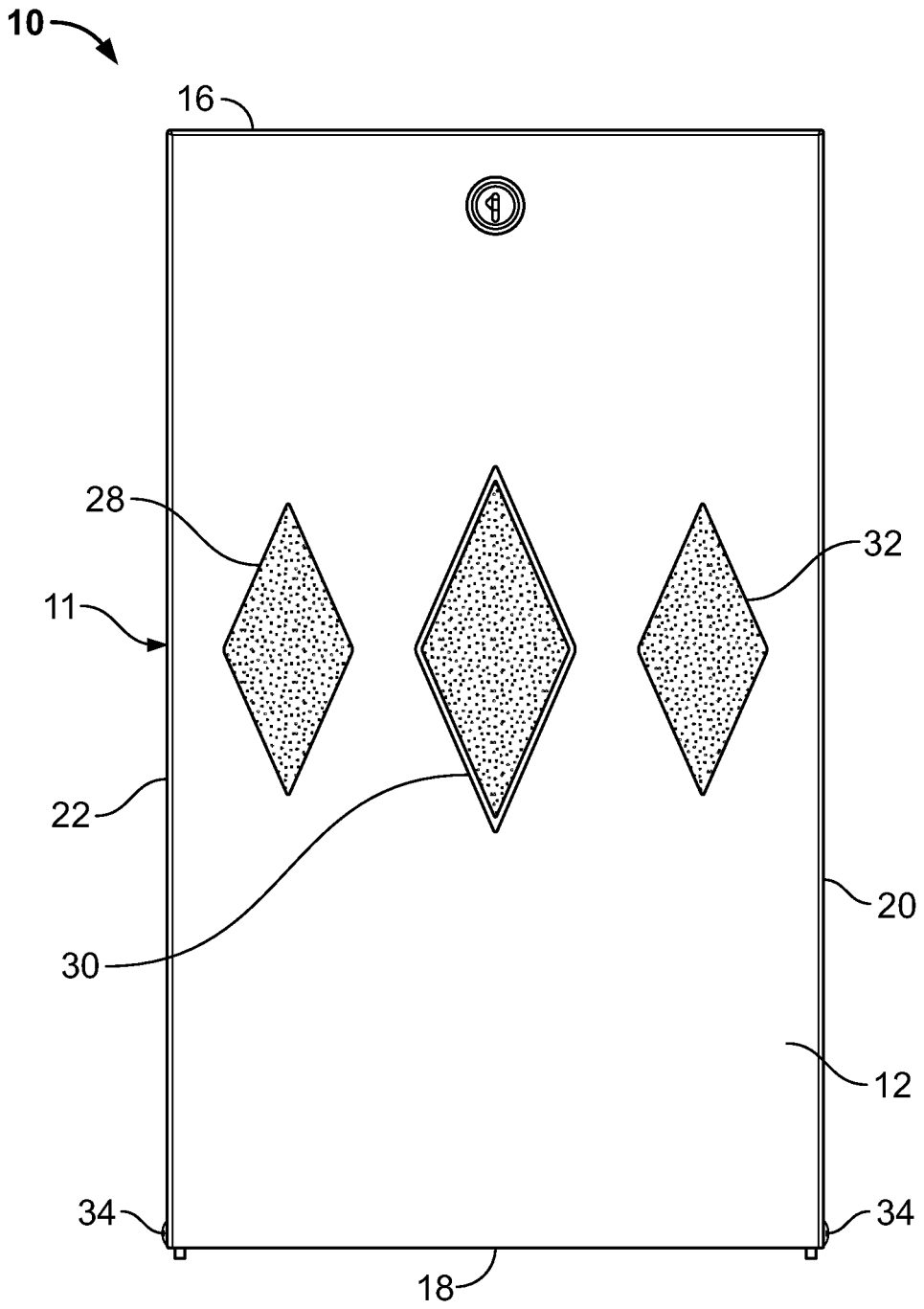
FIG. 2 is a front view of the pet waste bag dispenser of FIG. 1 in the closed position.
Figure 3:
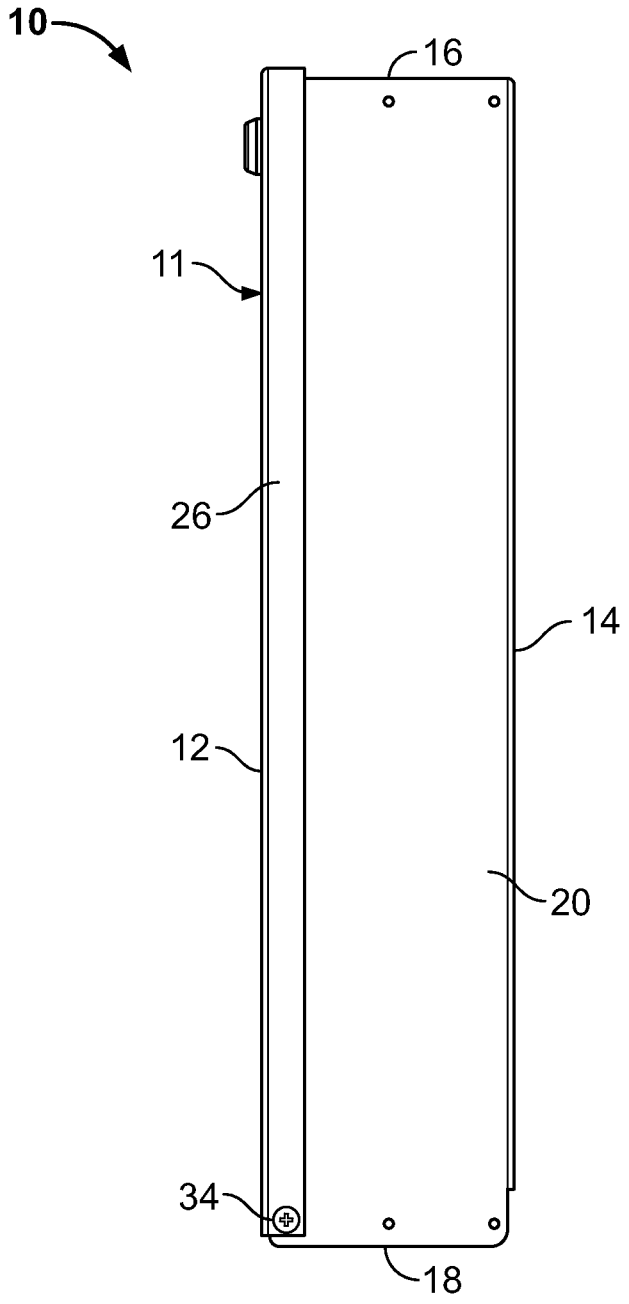
FIG. 3 is a side view of the pet waste bag dispenser in the closed position.

With reference now to FIGS. 1 and 2, the front panel 12 of the pet waste bag dispenser 10 includes at least open one opening for allowing pet waste bags disposed within the interior compartment 24 of the pet waste bag dispenser 10 to be dispensed through the front panel. In the illustrated embodiment, the front panel 12 has three diamond shapes openings 28, 30, 32 that are horizontally arranged in side-by-side relations. It is understood, however, that one or more of the openings 28, 30, 32 can have other suitable shapes (e.g., circular, square, rectangular, triangular). It is also understood that in embodiments having more than one opening 28, 30, 32, the openings can have any suitable relative arrangements (e.g., vertically arranged, diagonally arranged, random).

Each of the openings 28, 30, 32 in the front panel 12 is configured for allowing pet waste bags to be dispensed through the opening. That is, pet waste bags disposed within the interior compartment 24 of the pet waste bag dispenser 10 can be accessed through any one of the openings 28, 30, 32 in the front panel. In the illustrated embodiment and as seen in FIGS. 1 and 2, the central opening 30 in the front panel 12 is larger than the openings 28, 32 disposed on its sides. It is contemplated, however, that the openings 28, 30, 32 can have substantially the same size, the central opening can be smaller than the two openings disposed on its sides, or that each of the openings can have different sizes.

Figure 7:
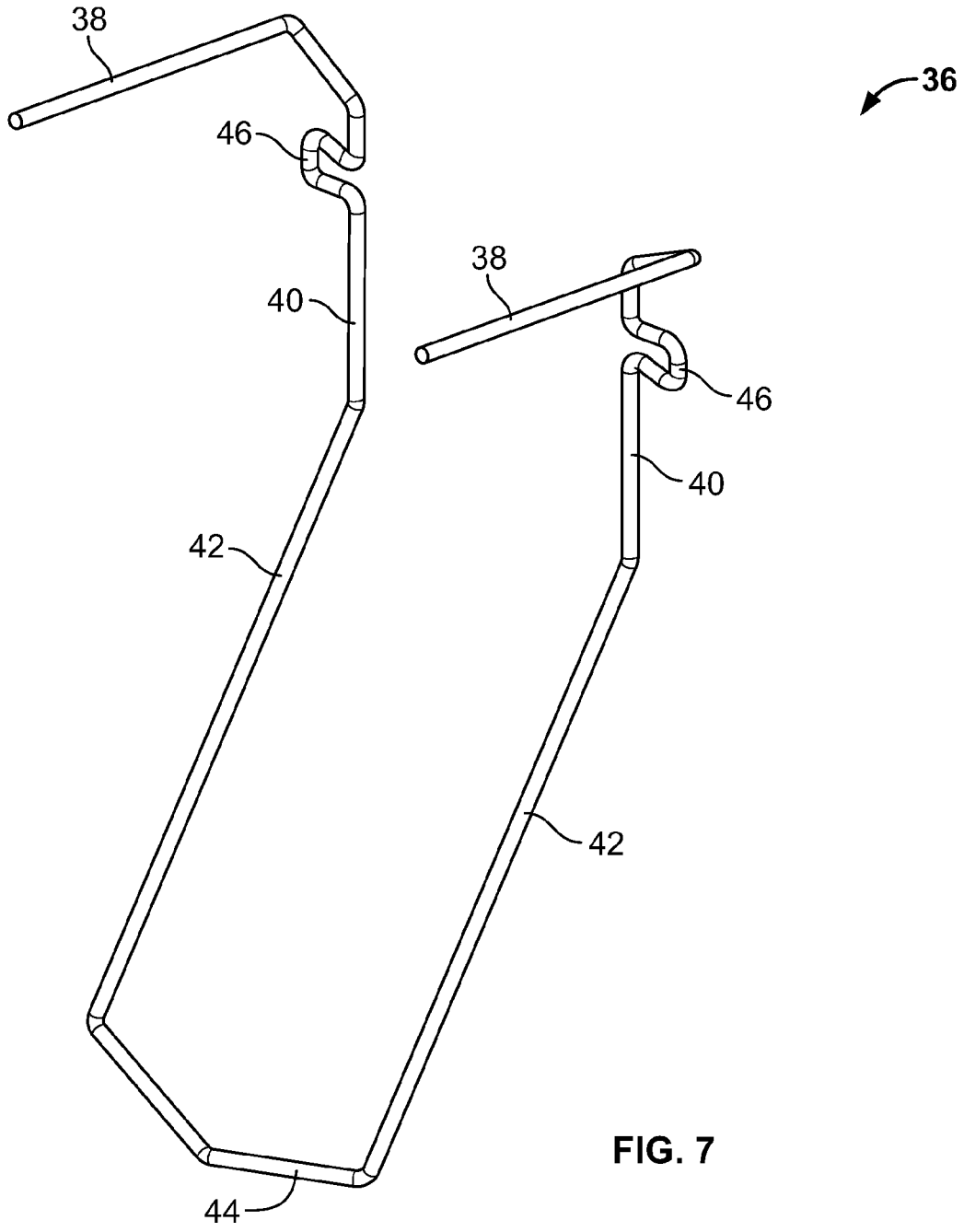
FIG. 7 is a perspective of a bag positioner of the pet waste bag dispenser.
Figure 8:
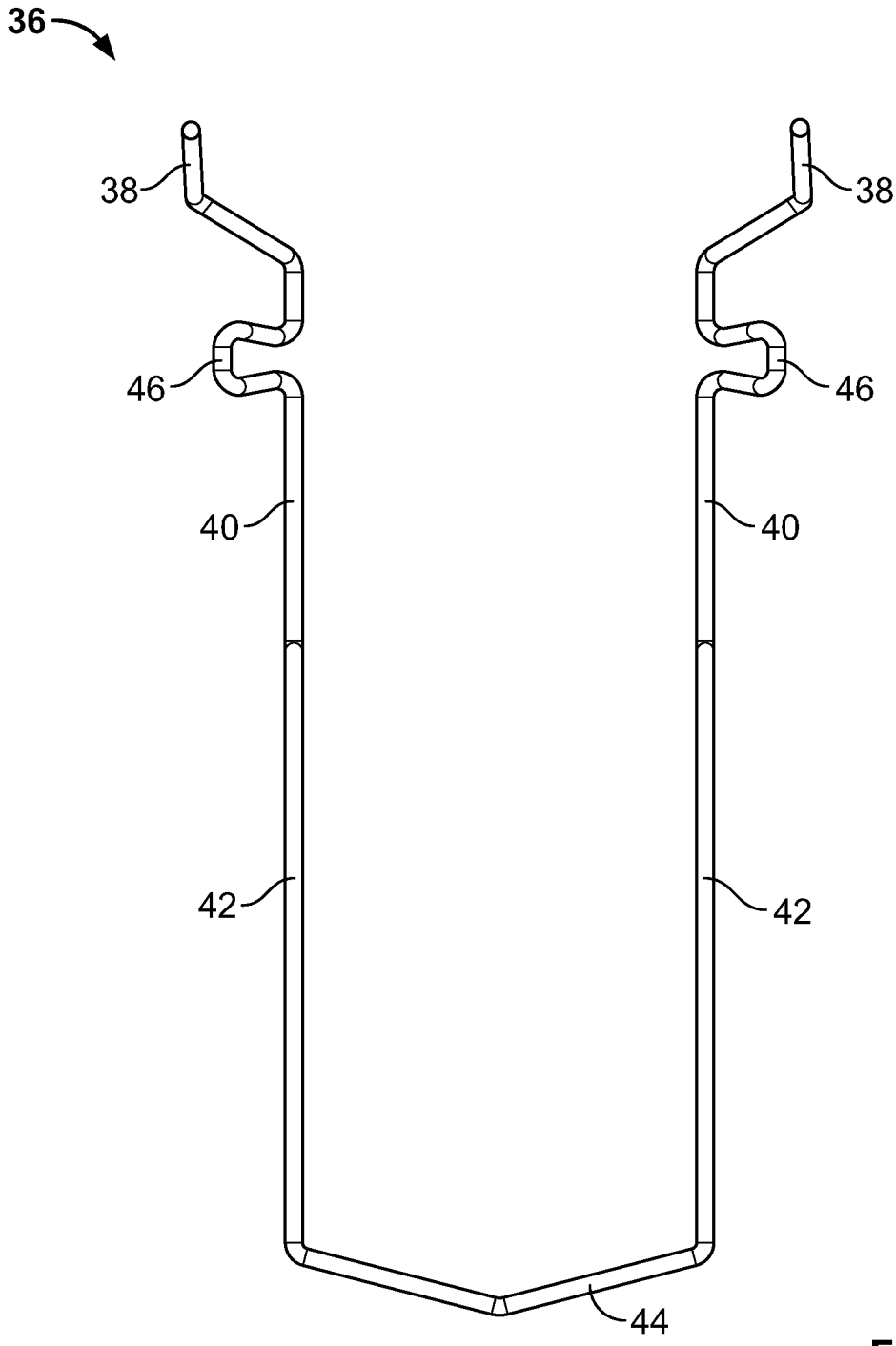
FIG. 8 is a front view of the bag positioner.
Figure 9:
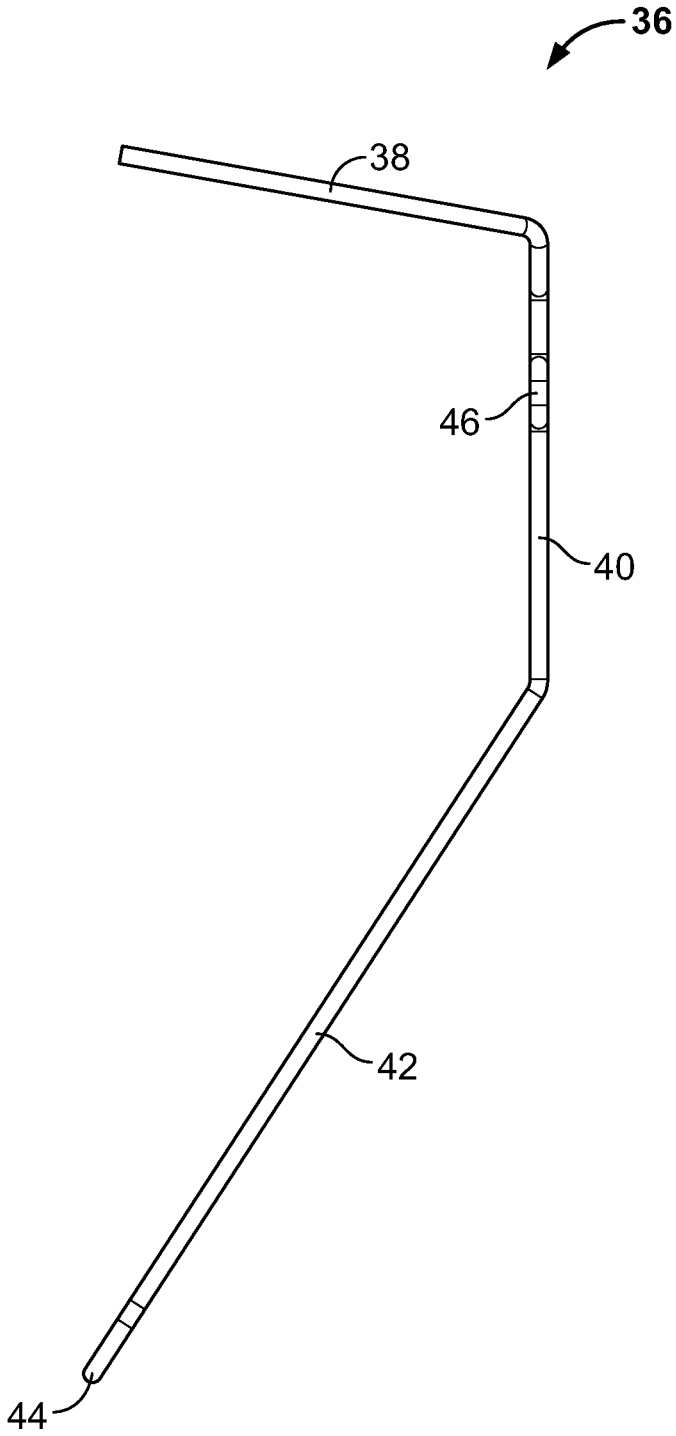
FIG. 9 is a side view of the positioner.

With reference again to FIGS. 4 and 5, the pet waste bag dispenser 10 further comprises a positioner, indicated generally at 36, mounted to the back panel 14 within the interior compartment 24 of the pet waste bag dispenser 10. As seen in FIG. 7-9, the positioner 36 includes a pair of spaced prongs 38, a medial portion 40 extending generally vertically downward from each of the prongs, and a pair of spacing portions 42 extending at an angle relative to the medial portions. In the illustrated embodiment, a connection portion 44 extends between and connects the two spacing portions 42 and each of the medial portions 40 of the positioner 36 has a catch 46.

Figure 10:
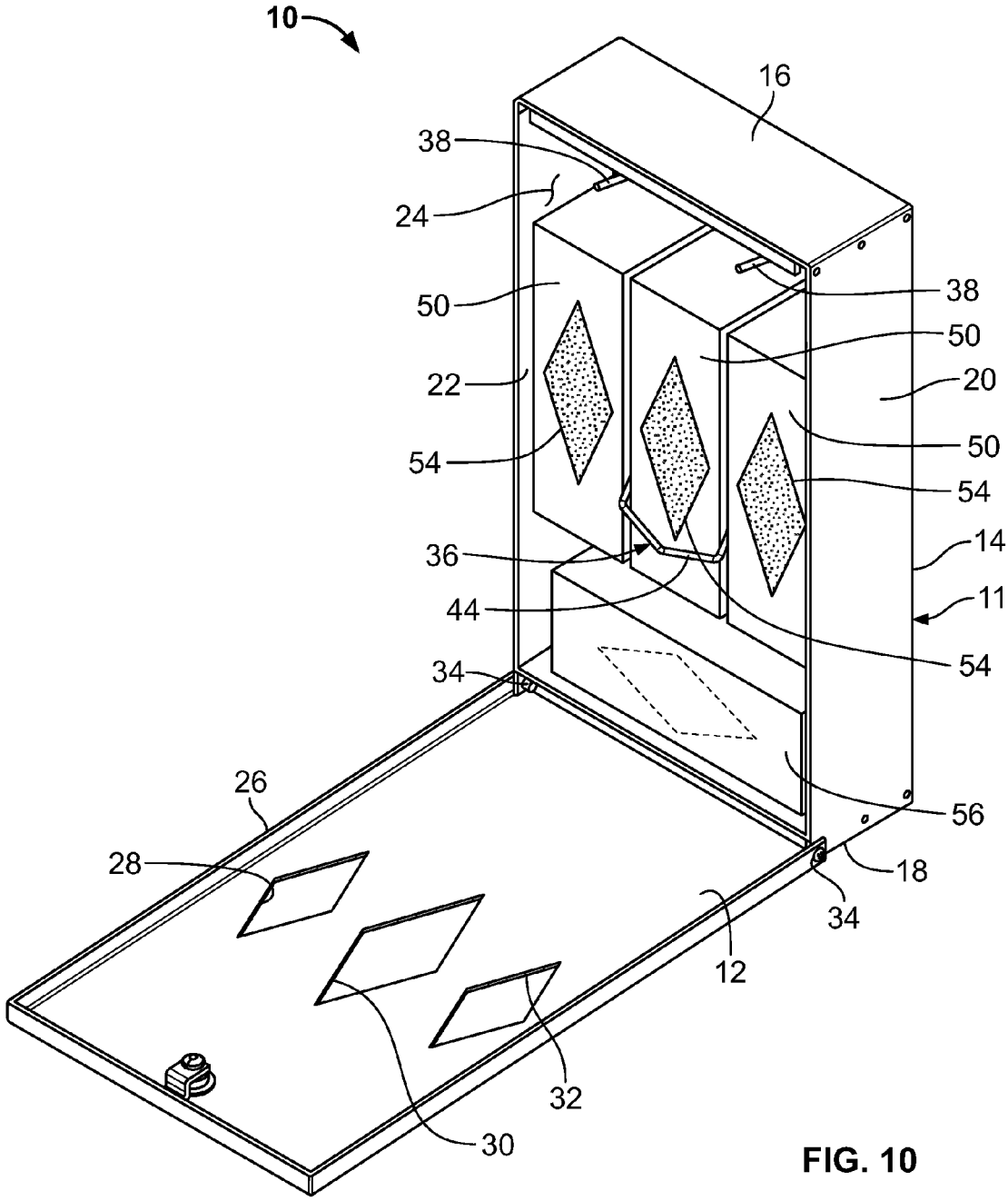
FIG. 10 is a perspective of the pet waste bag dispenser similar to FIG. 4 but illustrating a plurality of boxes containing rolled pet waste bags disposed within the pet waste bag dispenser.
Figure 11:
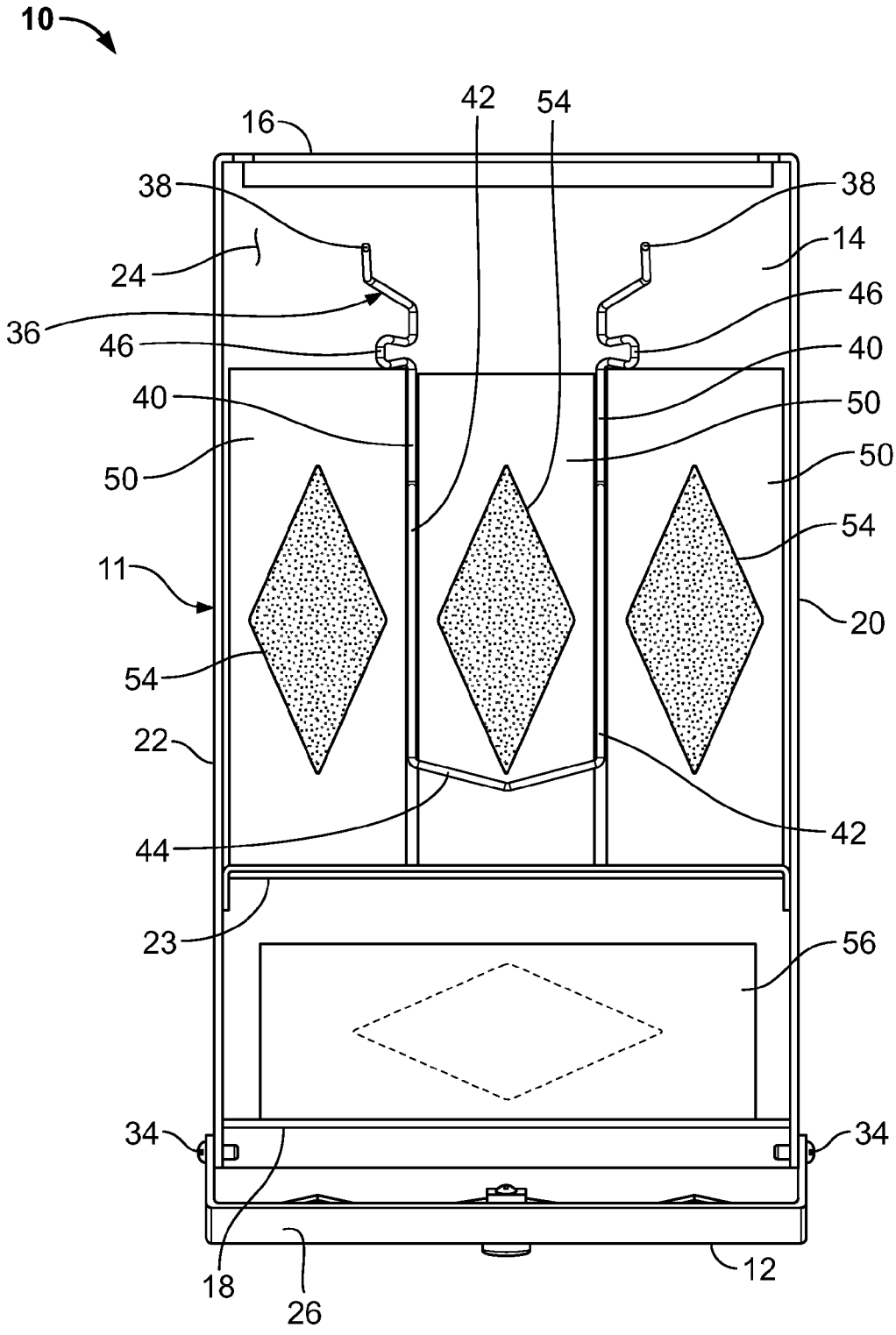
FIG. 11 is a front view of the pet waste bag dispenser of FIG. 10.
Figure 12:
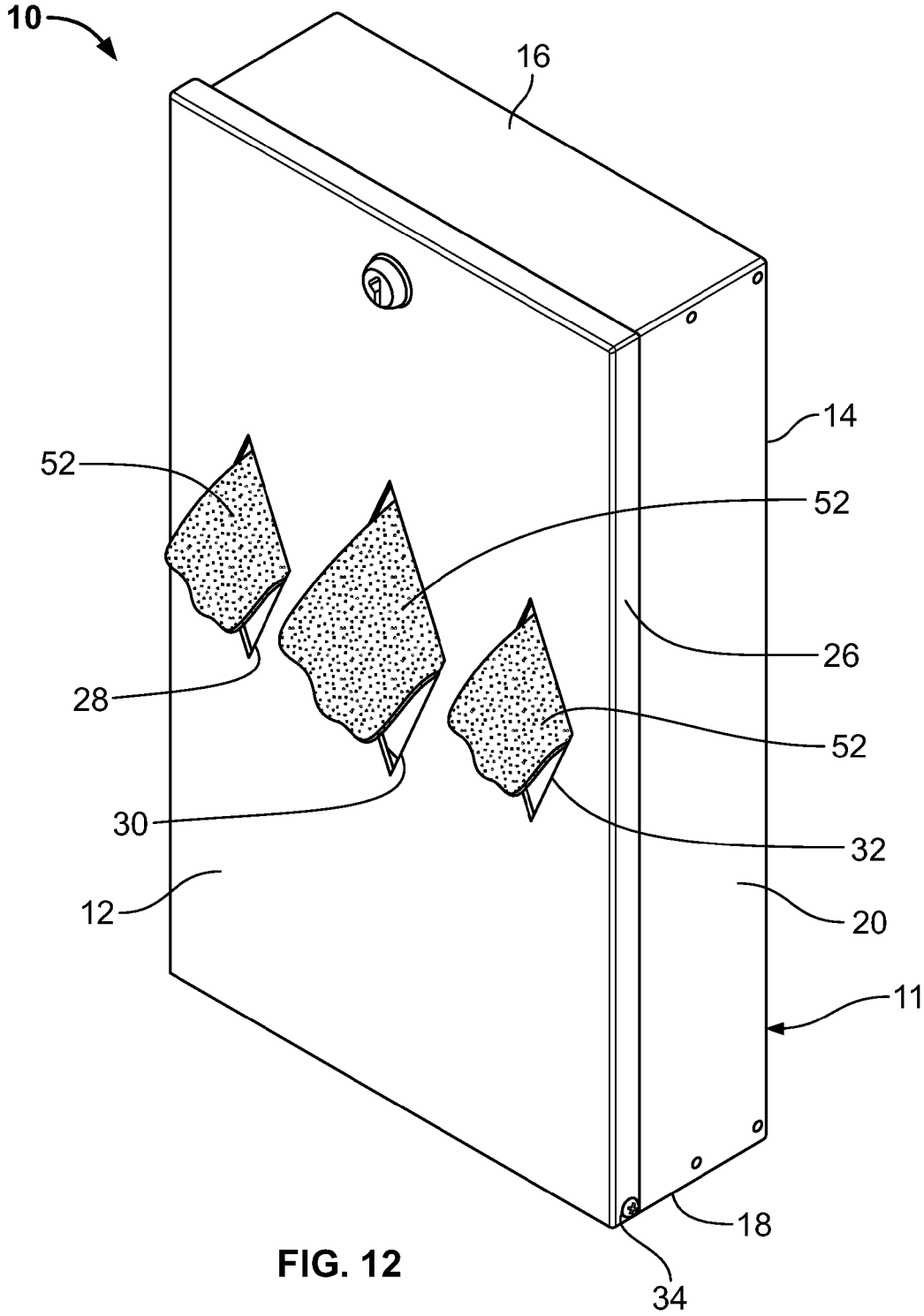
FIG. 12 is a perspective of the pet waste bag dispenser similar to FIG. 10 but illustrating the pet waste bag dispenser in the closed position and a plurality of pet waste bag extending therefrom.

In one potential use, which is illustrated in FIGS. 10-12, the pet waste dispenser 10 is configured to hold a plurality of boxes, indicated generally at 50, containing rolled pet waste bags 52. Three boxes 50 of rolled pet waste bags 52 can be disposed vertically within the interior compartment 24 of the pet waste bag dispenser 10 such that openings 54 in the boxes generally align with the openings 28, 30, 32 in the front panel 12. As seen in FIGS. 10 and 11, each of the boxes 50 rests on the shelf 23. Two of the boxes 50 (the left and right most boxes as viewed in FIGS. 10 and 11) are held in vertical alignment (i.e., inhibited from canting) by the respective side panels 20, 22 and the positioner 36 and more specifically, the respective medial portions 40 and spacing portions 42 of the positioner. As seen in FIG. 11, the catches 46 of the medial portions 40 of the positioner 36 locate the two outer boxes 50 (i.e., the boxes disposed adjacent one of the side panels 20, 22). The center box 50 is disposed between the medial portions 40 and spacing portions 42 of the positioner 36. Thus, the spacing between the medial portions 40 and spacing portions 42 of the positioner 36 is predetermined to be generally equal to or slightly greater than the width of the boxes 50. The connecting portion 44 of the positioner 36 extends across the center box 50 so that that the center box is disposed between the back panel 14 and the connecting portion 44.

With reference again to FIGS. 10 and 11, a spare or extra box 56 can be stored within the interior compartment 24 of the pet waste bag dispenser 10 on the bottom panel 18. In the illustrated embodiment, the spare box 56 is disposed below the other boxes 50 and the shelf 23 upon which the other boxes rest. It is contemplated, however, that the shelf 23 and thus, the space below the shelf 23 and the spare box 56 can be omitted. It is also contemplated that the interior compartment 24 of the pet waste bag dispenser 10 can be sized and shaped to receive more than one spare box 56.

FIG. 12 illustrates the rolled pet waste bags 52 of the boxes 50 extending through the openings 28, 30, 32 in the front panel 12 of the pet waste bag dispenser 10. As a result, the pet waste bags 52 are readily available for use. That is, the pet waste bags 52 disposed within the interior compartment 24 of the pet waste bag dispenser 10 can be manually grasped through the openings 28, 30, 32 in the front panel 12 and separated from the respective roll, which is contained within one of the boxes 50. The pet waste bags 52 can be separated from the roll of pet waste bags by pulling the bag against one of the edges of the respective diamond-shaped opening 28, 30, 32. Once removed from the pet waste bag dispenser and separated from the roll, the pet waste bag 52 can be used to collect and dispose of pet waste.

Figure 13:
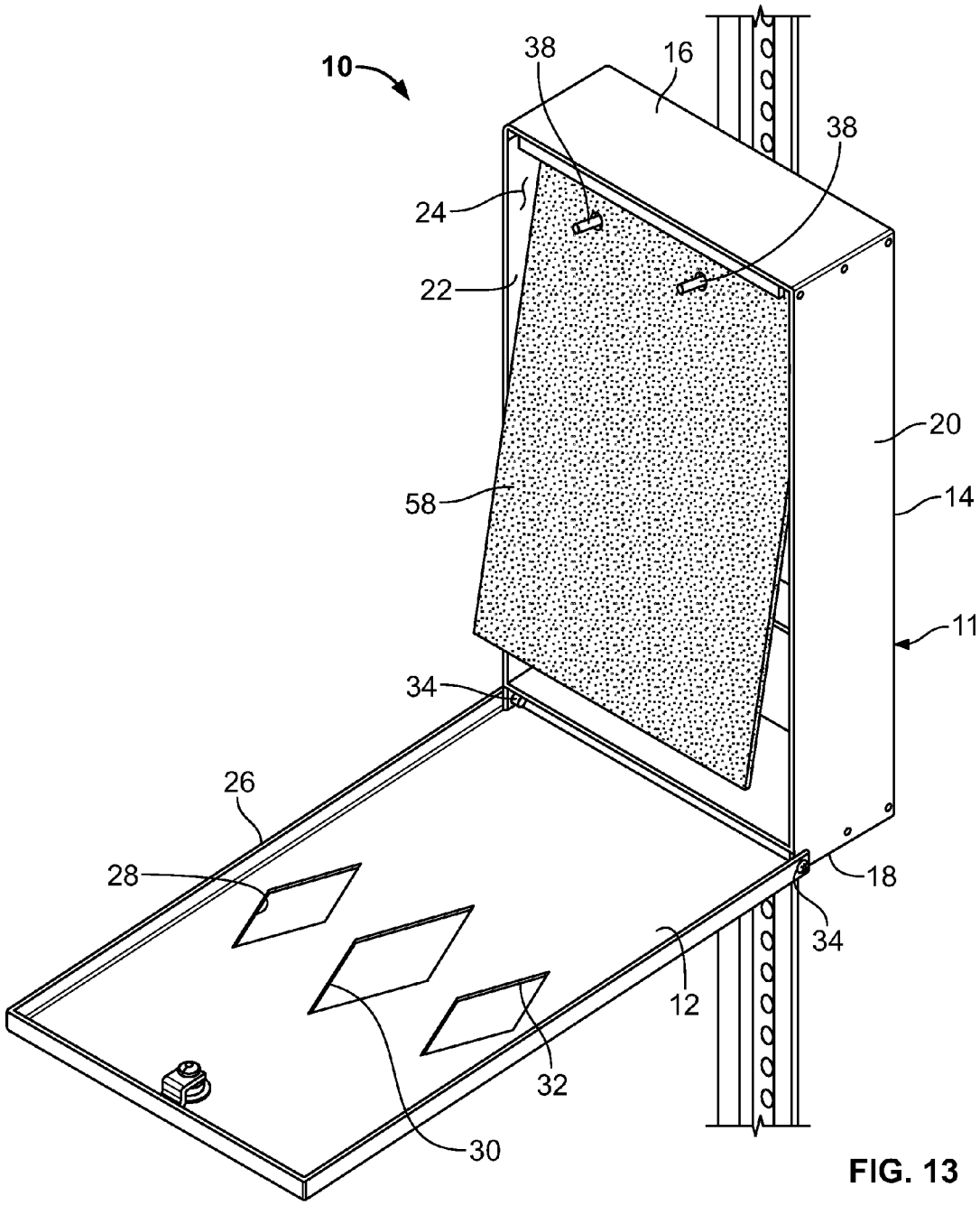
FIG. 13 is a perspective of the pet waste bag dispenser similar to FIG. 4 but illustrating a plurality of stacked pet waste bags disposed within the pet waste bag dispenser.
Figure 14:
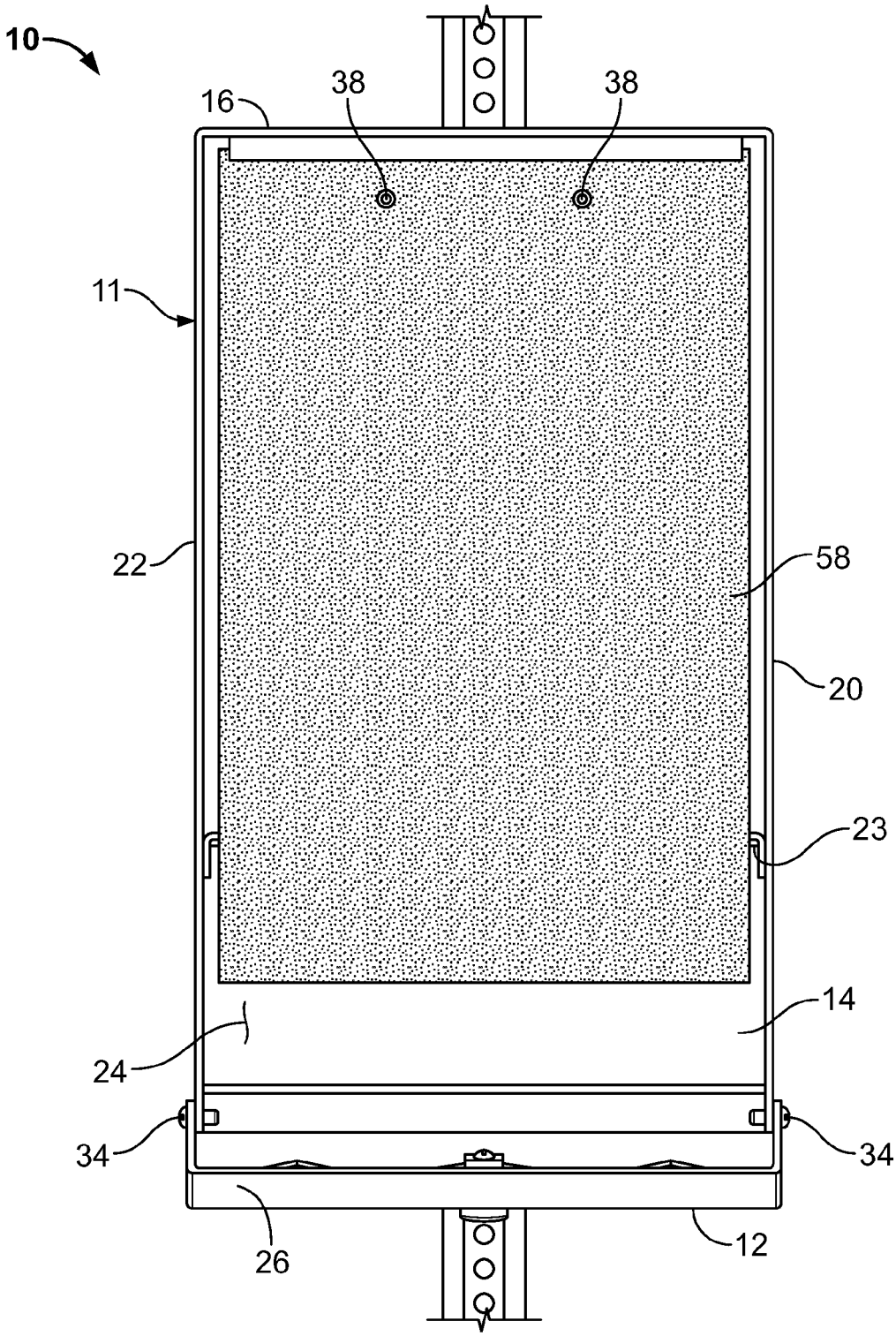
FIG. 14 is a front view of the pet waste bag dispenser of FIG. 13.
Figure 15:
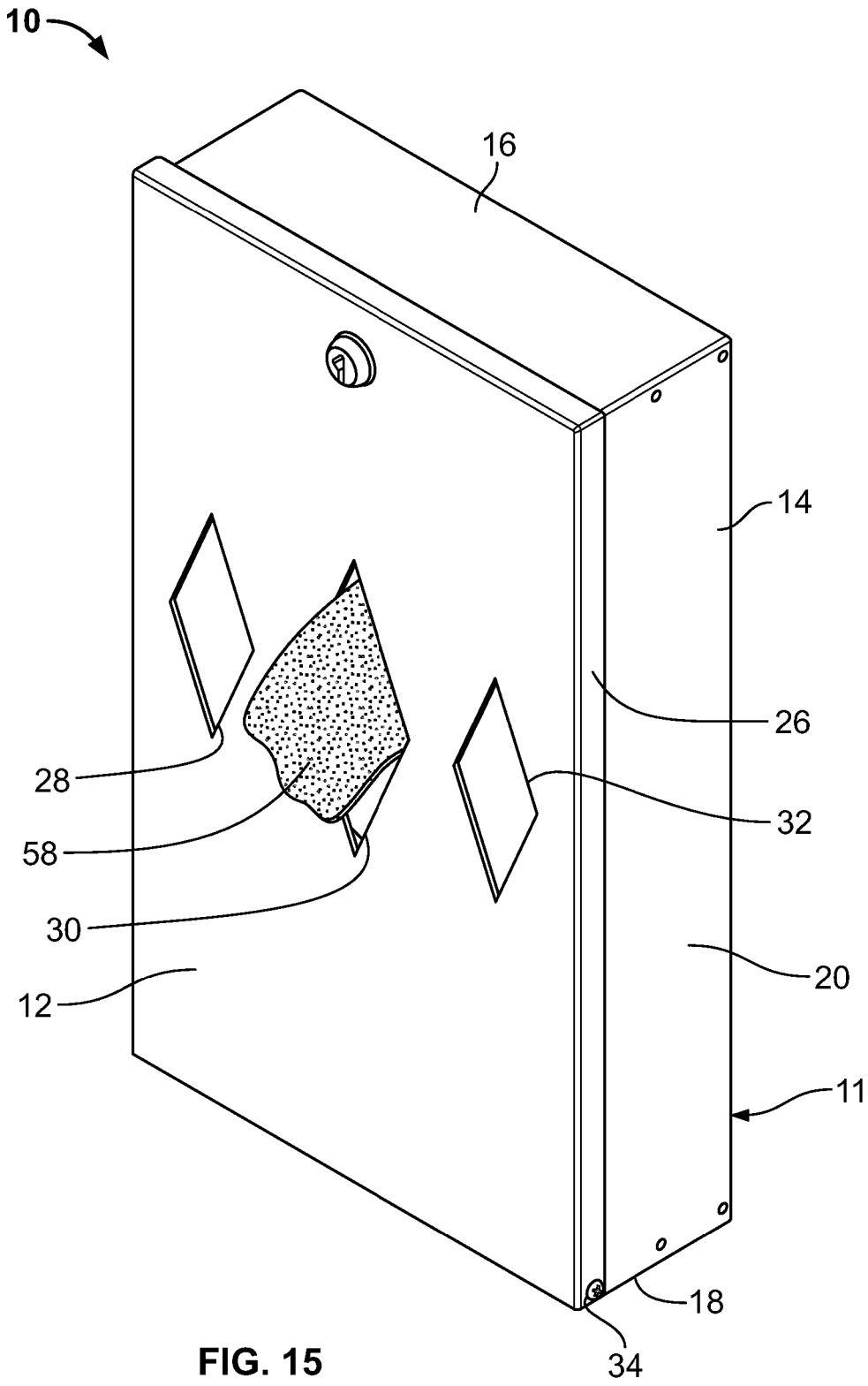
FIG. 15 is a perspective of the pet waste bag dispenser similar to FIG. 13 but illustrating the pet waste bag dispenser in the closed position and one of the stacked pet waste bags extending therefrom.

In another potential use, the pet waste bag dispenser 10 is configured to hold a plurality of stacked bags 58. As seen in FIGS. 13-15, the stacked bags 58 can be hung from the spaced prongs 38 of the positioner 36 such that the bags are disposed between the connecting portion 44 of the positioner and the front panel 12. The connecting portion 44 of the positioner 36 is arranged to locate the stacked bags 58 adjacent the central opening 30 in the front panel 12.

As seen in FIG. 15, one of the pet waste bags 58 is disposed adjacent to and is accessible through the center 30 in the front panel 12 of the pet waste bag dispenser 10. In the illustrated embodiment, at least one of the pet waste bags 58 extends through the opening 30. It is understood, however, that the pet waste bags 58 can be disposed adjacent to the opening 30 without extending through the opening. As a result, the pet waste bags 58 are readily available for use. That is, the pet waste bags 58 disposed within the interior compartment 24 of the pet waste bag dispenser 10 can be manually grasped through the central opening 30 in the front panel 12 and separated from the stack. Once removed from the pet waste bag dispenser 10 and separated from the stack, the pet waste bag 58 can be used to collect and dispose of pet waste.

Accordingly, the pet waste bag dispenser 10 is adapted to store and dispense both rolled pet waste bags 52 (FIGS. 10-12) and stacked pet waste bags 58 (FIGS. 13-15). In the illustrated embodiment, the housing 11 and the positioner 36 are adapted to receive only one of the rolled pet waste bags 52 and the plurality of stacked pet waste bags 58 at a given time. That is, rolled pet waste bags 52 and the stacked pet waste bags 58 cannot be used simultaneously in the illustrated embodiment of the pet waste bag dispenser 10. It is understood, however, that the pet waste bag dispenser 10 can be adapted to store and dispense both the rolled pet waste bags 52 and the stacked pet waste bags 58 at the same time.

In the illustrated embodiment, the pet waste bag dispenser 10 is made of a suitable metal (e.g., aluminum, steel). It is understood, however, that the pet waste bag dispenser 10 can be made of any suitable material (e.g., plastic).

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Moreover, the use of "top", "bottom", "above", "below" and variations of these terms is made for convenience, and does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A pet waste bag dispenser comprising:

a housing defining an interior compartment and having at least one opening in communication with the interior compartment; and a positioner located within the interior compartment of the housing, the positioner being configured to position at least one box containing rolled pet waste bags relative to the opening such that the rolled pet waste bags can be dispensed through the opening in the housing, the positioner also being configured to position a plurality of stacked pet waste bags relative to the opening such that the stacked pet waste bags can be dispensed through the opening in the housing, the positioner including a pair of spaced prongs, a medial portion extending generally vertically downward from each of the prongs, and a pair of spacing portions extending at an angle relative to the medial portions, wherein the housing has three openings in communication with the interior compartment and the housing is configured for receiving three boxes of rolled pet waste bags disposed vertically within the interior compartment such that openings in the boxes of rolled pet waste bags are generally align with the openings in the housing, one of the boxes of rolled pet waste bags being disposed between the spacing portions of the positioner and the other two boxes of rolled pet waste bags being disposed on opposite sides of the spacing portions of the positioner.

2. The pet waste bag dispenser as set forth in claim 1 wherein the positioner further comprises a connecting portion, the connecting portion extending across the box of rolled pet waste bags disposed between the spacing portions of the positioner.

3. The pet waste bag dispenser set forth in claim 1 wherein prongs of the positioner are adapted to support the plurality of stacked bags such that the bags are disposed adjacent the opening in the housing.

4. The pet waste bag dispenser set forth in claim 3 wherein positioner further comprises a connecting portion, the connecting portion being arranged to locate the stacked bags adjacent the opening in the housing.

5. The pet waste bag dispenser as set forth in claim 1 in combination with at least one box of rolled pet waste bags.

6. The pet waste bag dispenser as set forth in claim 1 in combination with a plurality of stacked pet waste bags.

7. A pet waste bag dispenser comprising:

a housing defining an interior compartment and having at least one opening in communication with the interior compartment, the interior compartment being sized and shaped to receive one of at least one box of rolled pet waste bags and a plurality of stacked pet waste bags; and a positioner located within the interior compartment of the housing, the positioner including a pair of spaced prongs, a medial portion extending generally vertically downward from each of the prongs, a pair of spacing portions extending at an angle relative to the medial portions, and a connecting portion extending between and connecting the spaced portions, wherein the positioner is configured to position the at least one box containing rolled pet waste bags relative to the opening such that the rolled pet waste bags can be dispensed through the opening in the housing, the connecting portion being configured to extend across the box of rolled pet waste bags disposed between the spacing portions of the positioner;

the positioner also being configured to position a plurality of stacked pet waste bags relative to the opening such that the stacked pet waste bags can be dispensed through the opening in the housing, the prongs of the positioner being adapted to support the plurality of stacked bags such that the bags are disposed adjacent the opening in the housing and the connecting portion being arranged to locate the stacked bags adjacent the opening in the housing when the stacked bags are supported by the prongs.

8. The pet waste bag dispenser set forth in claim 7 wherein the housing has three openings in communication with the interior compartment and the housing is configured for receiving three boxes of rolled pet waste bags disposed vertically within the interior compartment such that openings in the boxes of rolled pet waste bags are generally align with the openings in the housing.

9. A pet waste bag dispenser comprising:

a housing defining an interior compartment and having at least one opening in communication with the interior compartment, the interior compartment being sized and shaped to receive one of at least one box of rolled pet waste bags and a plurality of stacked pet waste bags; and a positioner located within the interior compartment of the housing, the positioner including a pair of spaced prongs, a medial portion extending generally vertically downward from each of the prongs, a pair of spacing portions extending at an angle relative to the medial portions, and a connecting portion extending between and connecting the spaced portions, wherein the positioner is configured to position the at least one box containing rolled pet waste bags relative to the opening such that the rolled pet waste bags can be dispensed through the opening in the housing, the connecting portion being configured to extend across the box of rolled pet waste bags disposed between the spacing portions of the positioner, wherein one of the boxes of rolled pet waste bags is disposed between the spacing portions of the positioner and two other boxes of rolled pet waste bags are disposed on opposite sides of the spacing portions of the positioner;

the positioner also being configured to position a plurality of stacked pet waste bags relative to the opening such that the stacked pet waste bags can be dispensed through the opening in the housing, the prongs of the positioner being adapted to support the plurality of stacked bags such that the bags are disposed adjacent the opening in the housing and the connecting portion being arranged to locate the stacked bags adjacent the opening in the housing when the stacked bags are supported by the prongs.

10. A pet waste bag dispenser comprising:

a housing defining an interior compartment and having at least one opening in communication with the interior compartment, the interior compartment being sized and shaped to receive one of at least one box of rolled pet waste bags and a plurality of stacked pet waste bags, the housing comprising a front panel, a back panel, a top panel, a bottom panel, and a pair of side panels, the at least one opening being located in the front panel; and a positioner located within the interior compartment of the housing, the positioner including a pair of spaced prongs, a medial portion extending generally vertically downward from each of the prongs, a pair of spacing portions extending at an angle relative to the medial portions, and a connecting portion extending between and connecting the spaced portions, wherein the positioner is configured to position the at least one box containing rolled pet waste bags relative to the opening such that the rolled pet waste bags can be dispensed through the opening in the housing, the connecting portion being configured to extend across the box of rolled pet waste bags disposed between the spacing portions of the positioner;

the positioner also being configured to position a plurality of stacked pet waste bags relative to the opening such that the stacked pet waste bags can be dispensed through the opening in the housing, the prongs of the positioner being adapted to support the plurality of stacked bags such that the bags are disposed adjacent the opening in the housing and the connecting portion being arranged to locate the stacked bags adjacent the opening in the housing when the stacked bags are supported by the prongs, wherein the housing further comprises a shelf disposed within the interior compartment of the housing and extending between the side panels, the at least one box of rolled pet waste bags resting on the shelf when the at least one box of rolled pet waste bags is disposed within the interior compartment and positioned relative to the opening.

11. The pet waste bag dispenser set forth in claim 10 wherein the shelf is spaced from the bottom panel to receive a spare box of rolled pet waste bags.

12. The pet waste bag dispenser as set forth in claim 7 in combination with at least one box containing rolled pet waste bags.

13. The pet waste bag dispenser as set forth in claim 7 in combination with a plurality of stacked pet waste bags.

14. The pet waste bag dispenser set forth in claim 7 wherein the housing and positioner are adapted to receive only one of the rolled pet waste bags and the plurality of stacked pet waste bags at a given time.

15. The pet waste bag dispenser set forth in claim 7 within the positioner is a single-piece.

* * * * *